US008807150B2

(12) United States Patent
Boyer et al.

(10) Patent No.: US 8,807,150 B2
(45) Date of Patent: Aug. 19, 2014

(54) DISHWASHER SPRAY ARM ASSEMBLY WITH REDUCED LEAKAGE JOINT

(75) Inventors: Joel Charles Boyer, Louisville, KY (US); Errin Gnadinger, Louisville, KY (US); Satish Kumar Raju Buddharaju, Louisville, KY (US)

(73) Assignee: General Electric Company, Schenectady, NY (US)

( * ) Notice: Subject to any disclaimer, the term of this patent is extended or adjusted under 35 U.S.C. 154(b) by 714 days.

(21) Appl. No.: 13/101,409

(22) Filed: May 5, 2011

(65) Prior Publication Data

US 2012/0279534 A1 Nov. 8, 2012

(51) Int. Cl.
*B08B 3/00* (2006.01)

(52) U.S. Cl.
USPC ..... 134/198

(58) Field of Classification Search
CPC ..... A47L 15/22; A47L 15/23; A47L 15/4225
USPC ..... 134/198
See application file for complete search history.

(56) References Cited

U.S. PATENT DOCUMENTS

| | | | | |
|---|---|---|---|---|
| 3,430,861 | A | 3/1969 | Geiger et al. | |
| 5,727,581 | A | 3/1998 | Tekriwal et al. | |
| 2006/0054204 | A1 | 3/2006 | Fischer | |
| 2009/0145981 | A1 * | 6/2009 | Mack et al. | 239/261 |

* cited by examiner

*Primary Examiner* — Michael Barr
*Assistant Examiner* — Spencer Bell
(74) *Attorney, Agent, or Firm* — Dority & Manning, P.A.

(57) ABSTRACT

A dishwasher spray arm assembly has a spray arm rotationally configured on a conduit. The spray arm includes a lower spray arm component mated with an upper spray arm component with an internal space defined between the upper and lower spray arm components. A bearing is interposed between the spray arm and conduit to conduct water from said conduit into the internal space, with the spray arm rotatably configured on the bearing. The bearing further includes a lower shaft section that mates with the conduit and an upper disc section sandwiched between the upper and lower spray arm components. A low-friction washer is disposed between the upper disc section and the lower spray arm component. The lower spray arm component and the disc section define a tortuous interference path for water to leak out from the internal space around the bearing.

20 Claims, 7 Drawing Sheets

FIG. –1–

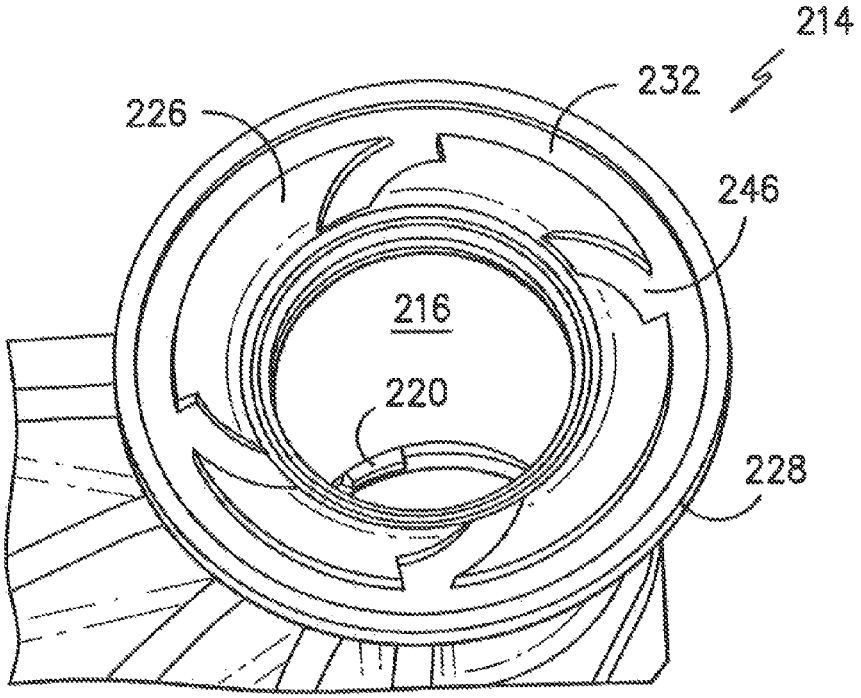
FIG. —4—
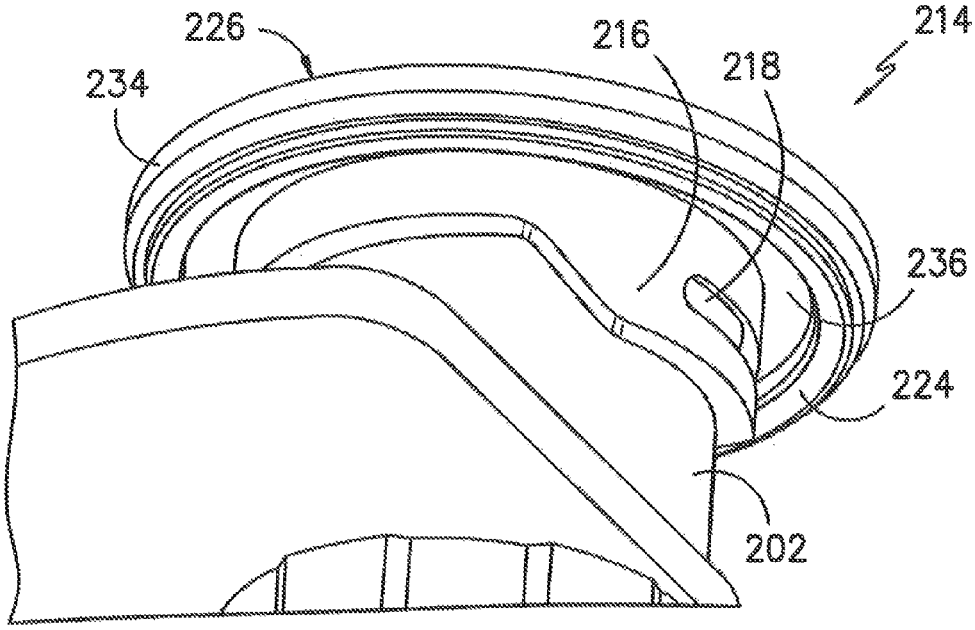
FIG. —5—

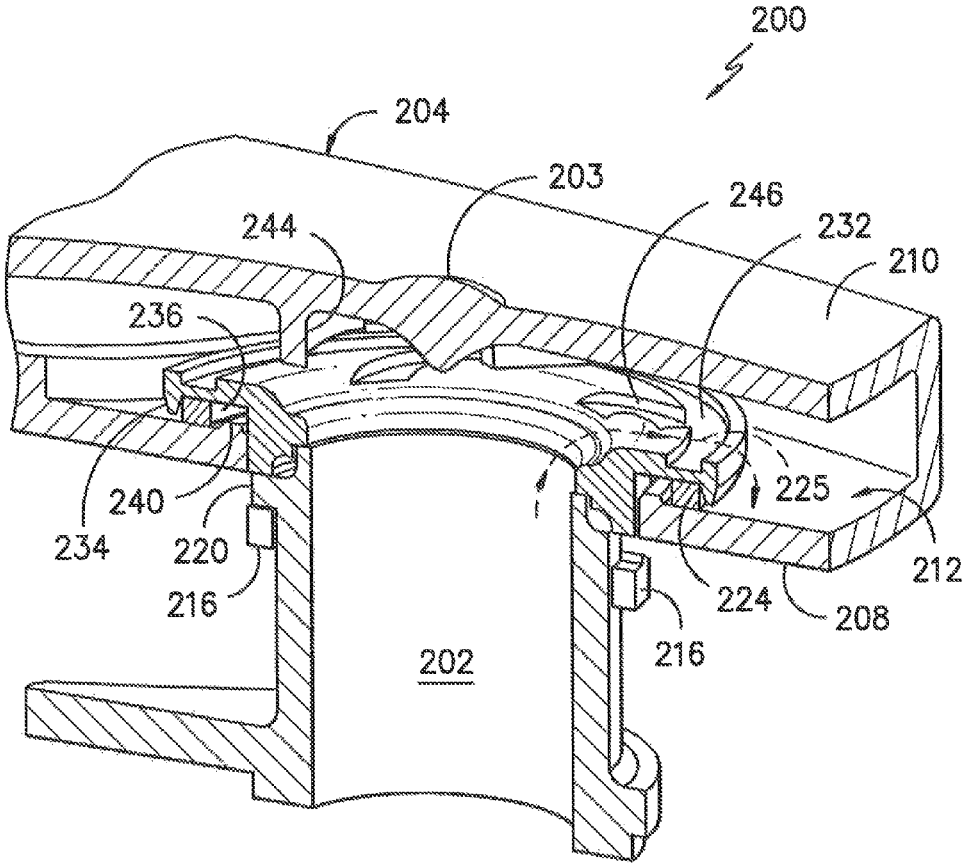
FIG. —6—

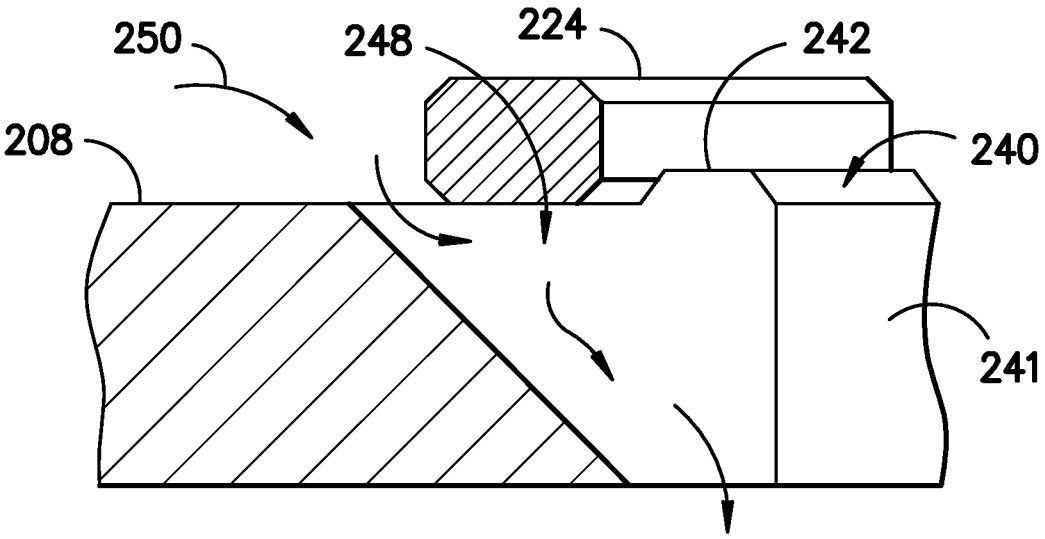
FIG. —9—

DISHWASHER SPRAY ARM ASSEMBLY WITH REDUCED LEAKAGE JOINT

FIELD OF THE INVENTION

The present invention relates generally to dishwashers, and more particularly to a dishwasher spray arm assembly.

BACKGROUND OF THE INVENTION

Conventional dishwashers have a number of washing and rinsing phases and a final drying phase. During a typical washing or rinsing phase, a pump forces washing or rinsing liquid upwardly through a conduit and into a rotating spray arm assembly. The washing liquid is distributed from the spray arm assembly by means of orifices or jets spaced along the radially extending arms of the assembly. The spray arms are reactively driven by having at least one of the orifices disposed to discharge a jet stream in a direction such that the spray arm reacts to the force of the discharge and rotates in a horizontal plane.

During a typical washing or rinsing phase, approximately 28-30 gallons of water per minute is pumped through the conduit assembly to the spray-arm assemblies. A relatively large amount of this flow (between 4-6 gallons) leaks through the seal at the joint between the stationary and moving portions of the conduit and the spray arm assembly. This water leakage is detrimental to the performance and reliability of the dishwasher and results in increased energy usage. In addition, as water leaks through the conduit and spray arm assembly, food particles carried by the water flow get lodged between the stationary and moving surfaces causing a reduced spray arm rotational speed that in turn reduces the overall washing performance of the dishwasher and possibly causes deterioration of the assembly.

Therefore, a need exists in the industry for a spray-arm joint assembly that lowers water leakage during washing or rinsing phases and addresses the problem of trapped particles causing deterioration of machine performance or component wear.

BRIEF DESCRIPTION OF THE INVENTION

Aspects and advantages of the invention will be set forth in part in the following description, or may be obvious from the description, or may be learned through practice of the invention.

In accordance with aspects of the invention, a dishwasher spray arm assembly includes a conduit that supplies water from a pump. A spray arm is rotationally configured on the conduit and includes a lower spray arm component mated with an upper spray arm component, with an internal space defined between the upper and lower spray arm components. A bearing is interposed between the spray arm and the conduit to conduct water from the conduit into the internal space of the spray arm, with the spray arm rotatably configured on the bearing. The bearing has a lower shaft section that mates with the conduit and an upper disc section sandwiched between the upper and lower spray arm components within the internal volume of the spray arm. A low-friction washer is disposed between the upper disc section and the lower spray arm component. The lower spray arm component and the disc section define a tortuous interference path for water to leak out from the internal space around the bearing.

In a particular embodiment of the spray arm assembly, the upper disc section of the bearing has a circumferential lip with a lower vertical aspect that defines a groove on an underside of the disc section. The washer is disposed within this groove and the interference path includes a path section around the circumferential lip and its lower vertical aspect, then upwards into the groove and over the washer. In this embodiment, the washer may be disposed against the lower vertical aspect of the circumferential lip such that the interference path further includes a path section between the lower vertical aspect and the washer.

The lower spray arm component may, in certain embodiments, have an inner radial lip with an upper vertical aspect that is concentric with the lower shaft section. The washer may be disposed between the upper vertical aspect and the lower vertical aspect of the disc section circumferential lip such that the interference path further includes a path section around the upper vertical aspect and between the inner radial lip and the shaft section.

In certain embodiments, inter-engaging structure may be defined between the bearing shaft section and the conduit to rotationally lock the bearing to the conduit. This structure may include, for example, tabs on the conduit that engage in grooves defined on the bearing shaft section.

In other embodiments, spacing ribs may be defined on an underside of the upper spray arm component that engage against the bearing upper disc section. In this embodiment, an upper radial groove may be defined in the bearing upper disc section, with the spacing ribs bridging the upper radial groove. Any manner of open flow directional grooves may be defined in the bearing to direct water flow from the shaft section into the upper radial groove, from which the water then moves into the internal volume of the spray arm.

It may be desired in certain embodiments to include at least one relief groove defined in the lower spray arm component at an orientation and location to provide a controlled leakage under the washer and out of the lower spray arm component radially outward of the bearing lower shaft section. These relief grooves may be variously configured. For example, a plurality of the grooves may be spaced circumferentially around the bearing lower shaft section. The relief grooves may be defined from a location radially outboard of the washer and through an inner radial lip of the lower spray arm component. The grooves may be defined by tangential grooves, or grooves having a horizontal and vertical component.

The invention also encompasses any manner of dishwasher having one or more spray arm assemblies within the scope and spirit of the invention.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 is a top perspective view of a component of the assembly of FIG. 3;

FIG. 5 is a side perspective side of a component of the assembly of FIG. 3;

FIG. 6 is a side cut-away view of an embodiment of a spray arm assembly;

FIG. 9 is a side cut-away view of an alternative embodiment of a relief groove.

DETAILED DESCRIPTION OF THE INVENTION

Figure 1:
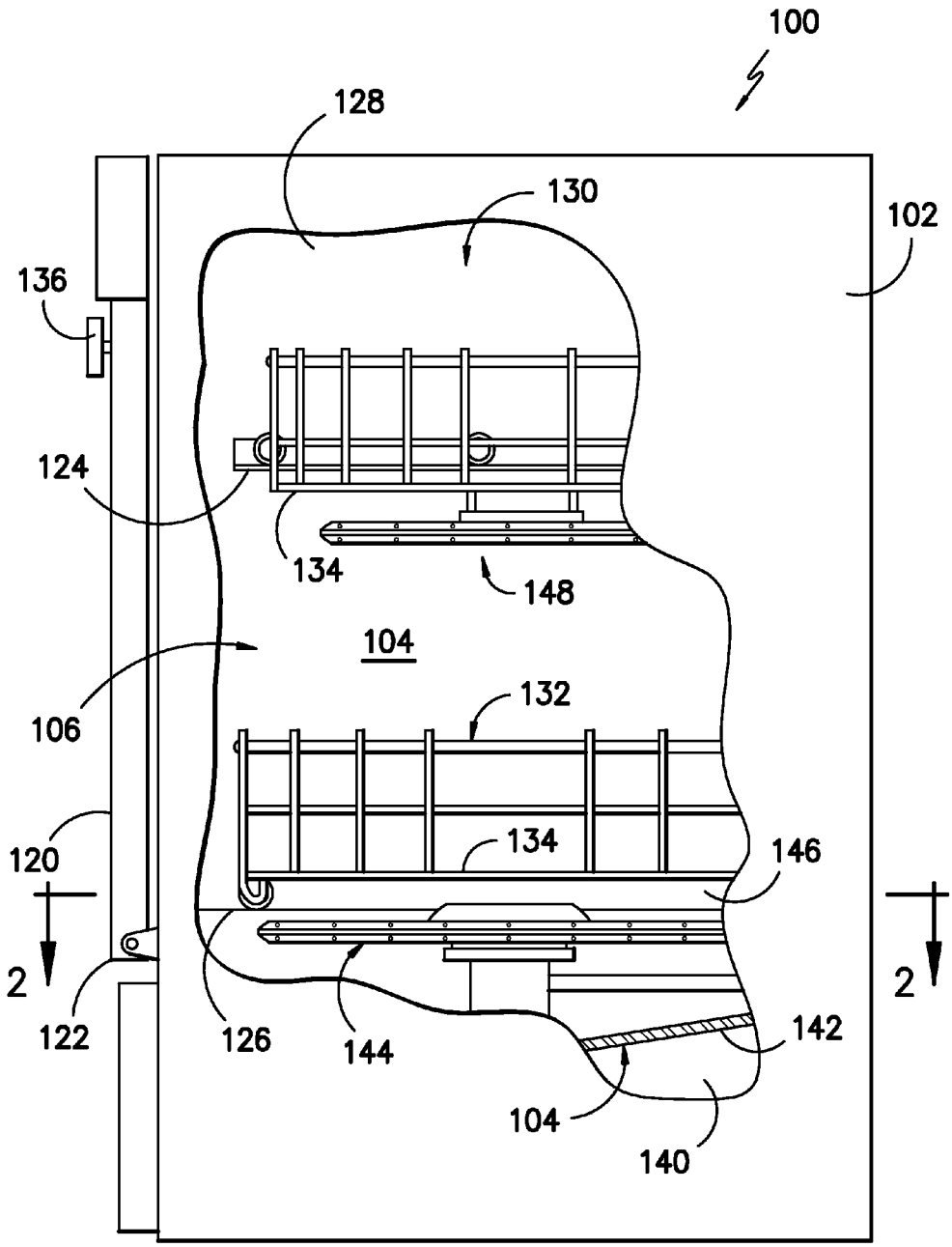
FIG. 1 is a side, partial cut-away view of an exemplary dishwasher.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a view of an exemplary domestic dishwasher 100 shown in partial cut-away and is representative of a type of a dishwasher that may incorporate a spray arm assembly in accordance with aspects of the invention. It should be appreciated, however, that the present spray arm assemblies are not limited to use in any particular type of dishwasher, and that the dishwasher 100 in FIG. 1 is presented for illustrative purposes only.

Briefly, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position wherein the wash chamber 106 is sealed shut for washing operation, and a horizontal open position for loading and unloading of dishwasher contents. Upper and lower guide rails 124, 126 are mounted on tub side walls 128 and accommodate upper and lower roller-equipped rack assemblies 130, 132, respectively.

A control input selector 136 is mounted at a convenient location on an outer face 138 of the door 120 and is coupled to control circuitry and control mechanisms for operating a fluid circulation assembly to circulate water and dishwasher fluid in the dishwasher tub 104. The fluid circulation assembly is located in a machinery compartment 140 located below a bottom sump portion 142 of the tub 104.

A lower spray-arm-assembly 200 is rotatably mounted within a lower region 146 of the wash chamber 106 and above tub sump portion 142 so as to rotate in relatively close proximity to the lower rack assembly 132. A mid-level spray-arm assembly 148 is located in an upper region of the wash chamber 106 and is located in close proximity to the upper rack 130 and at a sufficient height above lower rack 132 to accommodate larger items, such as a dish or platter. In a further embodiment, an upper spray assembly may be located above the upper rack assembly 130 at a sufficient height to accommodate taller items in the upper rack assembly 130.

Figure 2:
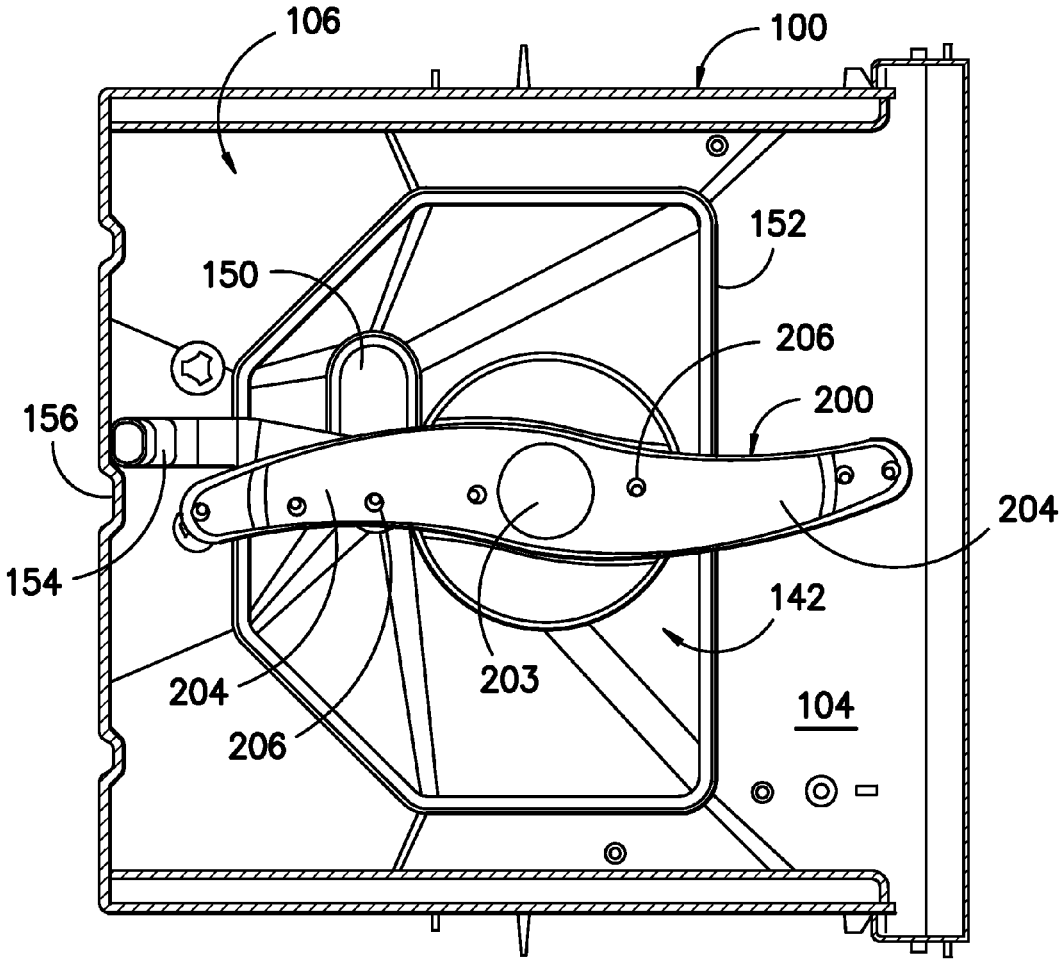
FIG. 2 is a top view of an exemplary spray arm assembly.

FIG. 2 is a top plan view of a dishwasher 100 just above the lower spray arm assembly 144. The tub 104 is generally downwardly sloped beneath the lower spray arm assembly 144 towards the tub sump portion 142, which is generally downwardly sloped toward a sump 150 in flow communication with the fluid circulation assembly. The tub sump portion 142 includes an outer perimeter 152 and the lower spray arm assembly is substantially centered within the tub 104 and wash chamber 106, off-centered with respect to the tub sump portion 142, and positioned above the tub 104 and the tub sump portion 142 to facilitate free rotation of the spray arm 144.

Water sprayed from the various spray arm assemblies is collected in the tub sump portion 142 and directed toward sump 150 for filtering and re-circulation via a pump (not depicted) during a dishwasher system wash cycle. In addition, a conduit 154 extends beneath lower spray arm assembly 200 and is in flow communication with the fluid circulation assembly for feeding wash fluid to mid-level spray arm assembly 148 and an upper spray arm assembly if provided. The lower spray arm assembly 200 includes radial arms 204 that extend from a central hub 203. A plurality of discharge nozzles 206 are provided on the arms 204 to discharge water supplied into the arms 204 from the fluid circulation assembly in a spray pattern within the wash chamber 106. The nozzles 206 are at an angular orientation to generate a rotational torque on the arms 204, which causes the spray arm assembly 204 to rotate when pressurized water is discharged, as in known in the art. The spray arm assembly 200 includes a joint that enables rotation of the arms and conveyance of water into the arms 204 with reduced leakage, as explained in greater detail below.

Referring to FIGS. 3 through 6 in general, a particular embodiment of a dishwasher spray arm assembly 200 is illustrated. The assembly 200 includes a stationary conduit 202 that is in fluid communication with the dishwasher's fluid distribution system for receipt of pressurized water from the dishwasher pump. A spray arm 204 is rotationally configured on the conduit 202. The spray arm 204 includes opposite radially extending portions that extend from the axis of the conduit 202, which may also be considered as the hub 203 of the spray arm assembly 200 (FIG. 6).

Figure 3:
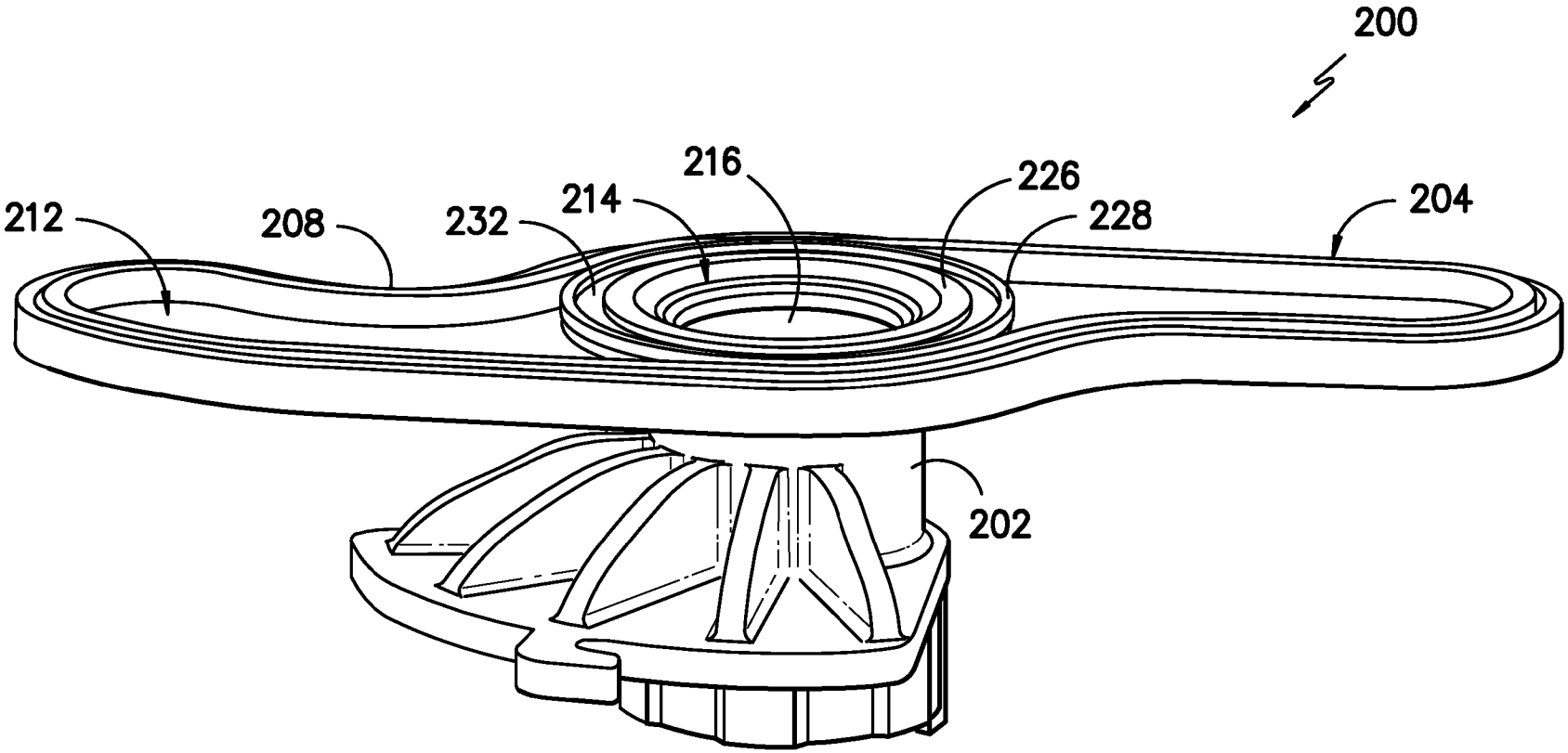
FIG. 3 is a perspective view of an embodiment of a spray arm assembly.

The spray arm 204 includes upper 210 and lower 208 components that may be integrally formed or may be formed as separate components that are mated together, as in the illustrated embodiments. For example, FIG. 3 depicts a lower spray arm component 208 that mates with an upper spray arm component 210 (FIG. 6), wherein a space 212 is defined between the spray arm components. Pressurized water is conducted from the conduit 202 and into this space 212. The water is discharged from the volume 212 via the nozzles 206 (FIG. 2).

A bearing 214 is interposed between the spray arm 204 and the conduit 202 that enables conduction of the pressurized water from the conduit 202 into the internal space 212 and renders the spray arm 204 rotatable relative to the conduit 202.

The bearing 214 includes a lower shaft section 216 that mates with the conduit 202. For example, the lower shaft section 216 may be configured as a collar that engages around the conduit 202, as particularly depicted in FIG. 5. Any other manner of suitable engagement configuration may be used in this regard.

The bearing 214 includes an upper disk section 226 that is sandwiched between the upper and lower spray arm components 210, 208 in an assembled state of the spray arm assembly 200, as particularly illustrated in FIG. 6.

A low-friction washer 224 is disposed between the upper disk section 226 and the lower spray arm component 208. Referring particularly to FIG. 6, the lower spray arm component 208 and the disk section 226 define a tortuous interference path 225 for water to leak out from the internal water conduction volume 212 around the bearing 214, as indicated by the dashed line in FIG. 6.

The upper disk section 226 may be variously configured. In the embodiment illustrated for example in FIGS. 3 through 6, the upper disk section 226 includes a circumferential lip 228 that has a lower vertical aspect 234. This lower aspect 234 defines a groove 236 on an underside of the disk section 226, as particularly illustrated in FIG. 5. The washer 224 may be disposed within this groove 236, wherein the interference path 225 includes a path section around the circumferential lip 228 and lower vertical aspect 234, then upwards into the groove 236 and over the washer 224 before the water can leak out from between the lower spray arm component 208 and the conduit 202.

In still a further embodiment, the washer 224 may be disposed against the lower vertical aspect 234 of the circumferential lip 228 such that the interference path 225 includes a path section that is between the lower vertical aspect 234 and the washer 224, as depicted in FIG. 6.

Figure 8:
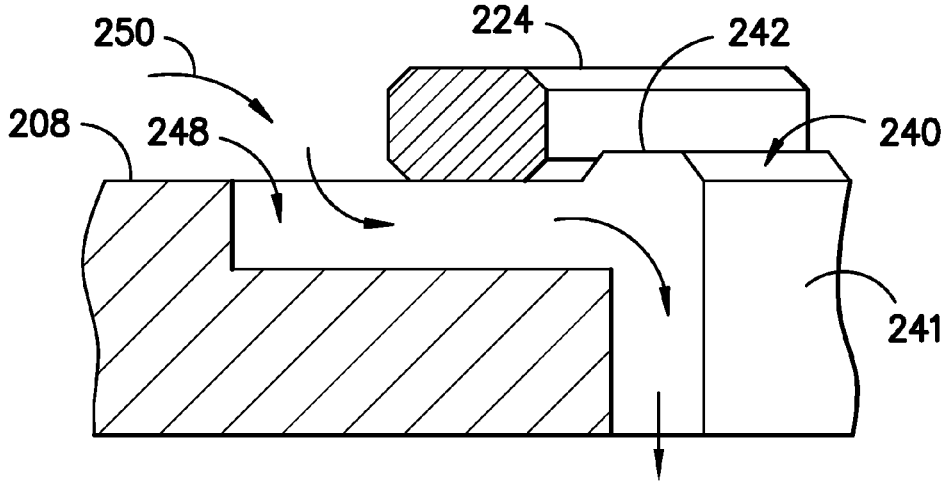
FIG. 8 is a side cut-away view taken along the lines indicated in FIG. 7.

Referring particularly to FIGS. 6 and 8, the lower spray arm component 208 may include an inner radial lip 240 with an upper vertical aspect 242 that is concentric with the lower shaft section 216. In this embodiment, the washer 224 may be disposed between this upper vertical aspect 242 and the lower vertical aspect 234 of the disk section 226, as depicted in FIG. 6, such that the interference path 225 also includes a path section around the upper vertical aspect 242 and between the inner radial lip 240 and the shaft section 216.

It should be appreciated that any manner of inter-engaging structure may be defined between the bearing shaft section 216 and the conduit 202 to rotationally lock the bearing 214 relative to the conduit 202. In the illustrated embodiment, this inter-engaging structure includes tabs 220 that project radially outward from the conduit 202. These tabs 220 engage within grooves 218 defined in the shaft section 216. One of the grooves 218 is particularly illustrated in FIG. 5.

In an alternate embodiment, the shaft section 216 may be permanently attached to the conduit 202 with an adhesive or like material. It should be appreciated that any manner of securing the bearing shaft 216 to the conduit 202 is within the scope and spirit of the invention.

Referring particularly to FIGS. 4 and 6, spacing ribs 244 may be provided on the underside of the upper spray arm component 210. These ribs 244 may engage against the bearing upper disk section 226 to provide rigidity and support to the overall configuration. In the illustrated embodiment, the ribs 244 bridge across an upper radial groove 232 defined in the upper disk section 226. A plurality of open flow directional grooves 246 may also be defined in the upper disk section 226 to direct water flow from the shaft section 216 into the upper radial grooves 232, and from there into the internal space 212 of the spray arm 204. Any manner of flow structure may be utilized in this regard to direct the flow of water into the arm 204.

Figure 7:
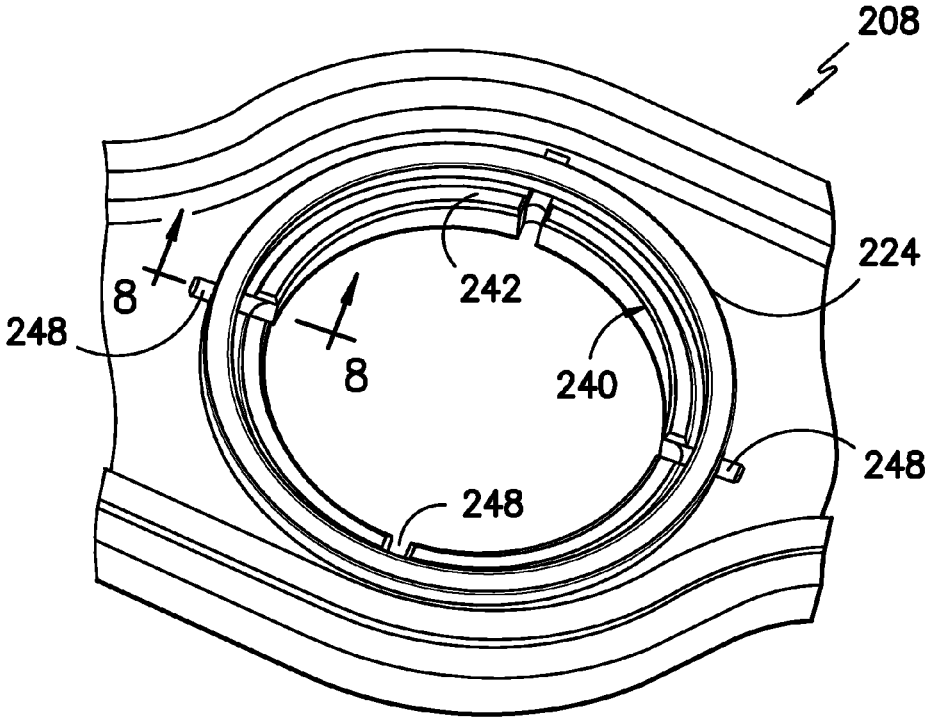
FIG. 7 is a top perspective view of components of an alternate embodiment of a spray arm assembly.

In certain embodiments, it may be desired to provide a controlled leak path through the bearing 214 in order to reduce the likelihood of small food (or other) particles inhibiting or actually jamming rotation of the spray arm 204 relative to the conduit 202. Reference is made to FIGS. 7 through 9 in this regard. At least one relief groove 248 may be defined in the lower spray arm component 208 at an orientation and location to provide a controlled leakage path 250 under the washer 224 and out of the lower spray arm component 208 radially outward of the bearing lower shaft section 216. In the embodiment of FIG. 7, a plurality of these relief grooves 248 are provided. The grooves 248 are defined through the upper vertical aspect 242 of the inner radial lip 240 of the lower spray arm component 208. With the washer 224 disposed outward and concentric to the inner radial lip 240, the relief grooves define a path from the internal volume 212, under the washer 224, and through an inner radial face 241 of the lower spray arm component 208, as particularly depicted in FIGS. 7 and 8.

The relief grooves 248 may be variously configured. In the embodiment of FIG. 8, the relief groove 248 has a generally horizontal upper component and a generally vertical component defined along the interface 241. The controlled leak path 250 is indicated by the lines in FIG. 8.

FIG. 9 depicts an alternative embodiment of a relief groove 248 that is defined by a generally tangential groove oriented from a location outboard of the washer 224 towards the interface 241. The leak path 250 is defined by the lines in FIG. 9 for this embodiment.

It should be appreciated also encompasses any manner of dishwasher 100 (FIG. 1) that incorporates one or more of the spray arm assemblies 200 in accordance with aspects described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher spray arm assembly, comprising:

a conduit;

a spray arm rotationally configured on said conduit, said spray arm further comprising a lower spray arm component mated with an upper spray arm component with an internal space defined between said upper and lower spray arm components;

a bearing interposed between said spray arm and said conduit to conduct water from said conduit into said internal space, said spray arm rotatably configured on said bearing;

said bearing further comprising a lower shaft section that mates with said conduit and an upper disc section sandwiched between said upper and lower spray arm components;

a low-friction washer disposed between said upper disc section and said lower spray arm component; and said lower spray arm component and said disc section defining a tortuous interference path for water to leak out from said internal space around said bearing.

2. The dishwasher spray arm assembly as in claim 1, wherein said upper disc section comprises a circumferential lip with a lower vertical aspect that defines a groove on an underside of said upper disc section, said washer disposed within said groove, wherein said interference path includes a path section around said circumferential lip and lower vertical aspect, then upwards into said groove and over said washer.

3. The dishwasher spray arm assembly as in claim 2, wherein said washer is disposed against said lower vertical aspect of said circumferential lip such that said interference path includes a path section between said lower vertical aspect and said washer.

4. The dishwasher spray arm assembly as in claim 3, wherein said lower spray arm component comprises an inner radial lip with an upper vertical aspect concentric with said lower shaft section, said washer disposed between said upper vertical aspect and said lower vertical aspect of said disc section circumferential lip such that said interference path includes a path section around said upper vertical aspect and between said inner radial lip and said shaft section.

5. The dishwasher spray arm assembly as in claim 1, further comprising inter-engaging structure defined between said bearing shaft section and said conduit to rotationally lock said bearing to said conduit.

6. The dishwasher spray arm assembly as in claim 5, wherein said inter-engaging structure comprises tabs on said conduit that engage in grooves defined on said bearing shaft section.

7. The dishwasher spray arm assembly as in claim 1, further comprising spacing ribs defined on an underside of said upper spray arm component that engage against said bearing upper disc section.

8. The dishwasher spray arm assembly as in claim 7, further comprising an upper radial groove defined in said bearing upper disc section, said spacing ribs bridging said upper radial groove, and further comprising open flow directional grooves defined in bearing to direct water flow from said shaft section into said upper radial groove.

9. The dishwasher spray arm assembly as in claim 1, further comprising at least one relief groove defined in said lower spray arm component at an orientation and location to provide a controlled leakage under said washer and out of said lower spray arm component radially outward of said bearing lower shaft section.

10. The dishwasher spray arm assembly as in claim 9, comprising a plurality of said relief grooves spaced circumferentially around said bearing lower shaft section.

11. The dishwasher spray arm assembly as in claim 10, wherein said lower spray arm component comprises an inner radial lip with an upper vertical aspect concentric with said lower shaft section, said washer disposed concentric to said upper vertical aspect, said relief grooves defined through said inner radial lip.

12. The dishwasher spray arm assembly as in claim 11, wherein said relief grooves are defined at a tangent to a vertical axis of said bearing from a location outboard of said washer through said inner radial lip.

13. The dishwasher spray arm assembly as in claim 11, wherein said relief grooves have a generally horizontal path segment from a location outboard of and under said washer, and a generally perpendicular path through said inner radial lip.

14. A dishwasher, comprising:

a spray arm assembly, said spray arm assembly further comprising:

a conduit;

a spray arm rotationally configured on said conduit, said spray arm further comprising a lower spray arm component mated with an upper spray arm component with an internal space defined between said upper and lower spray arm components;

a bearing interposed between said spray arm and said conduit to conduct water from said conduit into said internal space, said spray arm rotatably configured on said bearing;

said bearing further comprising a lower shaft section that mates with said conduit and an upper disc section sandwiched between said upper and lower spray arm components;

a low-friction washer disposed between said upper disc section and said lower spray arm component; and said lower spray arm component and said disc section defining a tortuous interference path for water to leak out from said internal space around said bearing.

15. The dishwasher as in claim 14, wherein said upper disc section comprises a circumferential lip with a lower vertical aspect that defines a groove on an underside of said upper disc section, said washer disposed within said groove, wherein said interference path includes a path section around said circumferential lip and lower vertical aspect, then upwards into said groove and over said washer.

16. The dishwasher as in claim 14, wherein said washer is disposed against said lower vertical aspect of said circumferential lip such that said interference path includes a path section between said lower vertical aspect and said washer.

17. The dishwasher as in claim 16, wherein said lower spray arm component comprises an inner radial lip with an upper vertical aspect concentric with said lower shaft section, said washer disposed between said upper vertical aspect and said lower vertical aspect of said disc section circumferential lip such that said interference path includes a path section around said upper vertical aspect and between said inner radial lip and said shaft section.

18. The dishwasher as in claim 14, further comprising at least one relief groove defined in said lower spray arm component at an orientation and location to provide a controlled leakage path under said washer and out of said lower spray arm component radially outward of said bearing lower shaft section.

19. The dishwasher as in claim 18, comprising a plurality of said relief grooves spaced circumferentially around said bearing lower shaft section, said lower spray arm component comprising an inner radial lip with an upper vertical aspect concentric with said lower shaft section, said washer disposed concentric to said upper vertical aspect, said relief grooves defined through said inner radial lip.

20. The dishwasher as in claim 19, wherein said relief grooves are defined at a tangent to a vertical axis of said bearing from a location outboard of said washer through said inner radial lip.

* * * * *